United States Patent [19]

Weber et al.

[11] Patent Number: 4,867,456

[45] Date of Patent: Sep. 19, 1989

[54] WIRE PUZZLE WITH CAPTURED ELEMENT HAVING A FURTHER CAPTURED ELEMENT INTERLOCKED THEREWITH

[76] Inventors: Harold C. Weber, 809 W. Park St., Riverton, Wyo. 82501; Bert V. McGee, 2400 Robinson St., Redondo Beach, Calif. 90278

[21] Appl. No.: 195,643

[22] Filed: May 18, 1988

[51] Int. Cl.[4] ..... A63F 9/08

[52] U.S. Cl. ..... 273/158

[58] Field of Search ..... 273/158; D21/106

[56] References Cited

U.S. PATENT DOCUMENTS

| | | | |
|---|---|---|---|
| 953,908 | 4/1910 | Hicks | 273/158 |
| 1,331,181 | 2/1920 | Bodnar | 273/158 |
| 4,524,972 | 6/1985 | Wilmarth | 273/158 |

*Primary Examiner*—Anton O. Oechsle

*Attorney, Agent, or Firm*—Leon Gilden

[57] ABSTRACT

A "captured heart" wire-form puzzle having multiple interlocked elements of a conventional design is improved through the use of one or more captured rings attached to the captured heart part of the puzzle. The removal of the captured heart member depends upon the correct postioning of the captured ring and as such, the ring operates to increase the complexity of the puzzle solution.

1 Claim, 2 Drawing Sheets

WIRE PUZZLE WITH CAPTURED ELEMENT HAVING A FURTHER CAPTURED ELEMENT INTERLOCKED THEREWITH

BACKGROUND OF THE INVENTION

1. Field of the Invention

The present invention relates to wire puzzles, and more particularly pertains to a new and improved "captured heart" wire-form puzzle that includes the use of at least one captured ring to increase the complexity of the puzzle solution.

2. Description of the Prior Art

Wire-form puzzles heretofor devised and utilized for the purpose of entertainment are known to consist basically of familiar, expected and obvious structural configurations. A myriad of various designs are encompassed by the crowded prior art and have been developed for the fulfillment of countless objectives and requirements. In this connection, the wire-form puzzle according to the present invention substantially departs from the conventional concepts and designs of the prior art, and in so doing provides an apparatus that is primarily developed for the purpose of increasing the complexity of conventional and commercially available wire-form puzzles without requiring the necessity of designing substantially different forms.

More particularly, wire-form puzzles are well known in the prior art, and "captured heart" wire-form puzzles have been the subject matter of prior art literature and patents. For example, U.S. Design Pat. No. 246,922, which issued to R. Heign on Jan. 10, 1978, shows the basic configuration of a captured heart wire-form puzzle wherein the heart is of a rectilinear design. Similarly, U.S. Design Pat. No. 258,601, which issued to J. Smallwood, Jr. on Mar. 17, 1981, discloses the same captured heart wire-form puzzle design with the only change consisting of forming the captured member more in the shape of a true heart design.

The solutions to these types of puzzles are also well known and described in the prior art. For example, U.S. Pat. No. 1,726,952, which issued to F. Gonzales on Sept. 3, 1929, probably represents the earliest captured heart wire-form puzzle design with a full description of the manner of solving this puzzle being provided. The Gonzales puzzle includes four interlocked U-shaped members about which a captured heart member must be manipulated before its release can be obtained.

A simpler design of the Gonzales wire-form puzzle is shown in U.S. Pat. No. 4,524,972 which issued to C. Wilmarth on June 25, 1985. The Wilmarth puzzles basically describes the variation of the puzzles illustrated in the above-referenced design patents and additionally, provides a detailed solution to the removal of the heart-shaped captured member from the interlocked U-shaped elements. The Wilmarth puzzle is illustrative of the crowded state of the prior art with respect to captured heart wire-form puzzles and is representative of the fact that minor improvements in this crowded prior art can constitute patentable achievement. Inasmuch as the Wilmarth wire form puzzle includes the basic components of the present invention, the disclosure thereof is incorporated by reference into the present invention.

Therefore, it can be appreciated that the crowded state of the prior art suggests that there exists a continuing need for improvements to wire-form puzzles which would increase their complexity and entertainment value. In this respect, the present invention substantially fulfills this need.

SUMMARY OF THE INVENTION

In view of the foregoing disadvantages inherent in the known types of wire-form puzzles now present in the prior art, the present invention provides an improved captured heart wireform puzzle construction wherein the complexity thereof is increased through the inclusion of a captured ring member movingly attached to the captured heart member, wherein said ring member can interfere with the removal of the captured heart member from its associated interlocked elements if such ring member is not properly positioned. As such, the general purpose of the present invention, which will be described subsequently in greater detail, is to provide a new and improved captured heart wire-form puzzle which has all the advantages and entertainment value of the prior art and none of the disadvantages.

To attain this, the present invention comprises a captured heart-wire form puzzle which is substantially similar in construction to the Wilmarth captured heart wire-form puzzle described above, and which further includes a circular ring member movingly interlocked with the captured heart member. When a user of the puzzle attempts to remove the captured heart member from its associated interlocked elements, the moveable ring member will interfere with such removal if it is not properly positioned on the heart member. Accordingly, the degree of complexity and challenge is increased through the use of this additional puzzle component.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways.

Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wire-form puzzle which has all the advantages of the prior art wire-form puzzles and none of the disadvantages.

It is another object of the present invention to provide a new and improvdd wire-form puzzle which may be easily and efficiently manufactured and marketed.

It is a further object of the present invention to provide a new and improved wire-form puzzle which is of a durable and reliable construction.

An even further object of the present invention is to provide a new and improved wire-form puzzle which is susceptible of a low cost of manufacture with regard to both materials and labor, and which accordingly is then susceptible of low prices of sale to the consuming public, thereby making such wire-form puzzles economically available to the buying public.

Still yet another object of the present invention is to provide a new and improved wire-form puzzle which provides in the apparatuses and methods of the prior art some of the advantages thereof, while simultaneously overcoming some of the disadvantages normally associated therewith.

Still another object of the present invention is to provide a new and improved wire-form puzzle which illustrates a simple means of increasing the complexity and entertainment value of presently available wire-form puzzles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
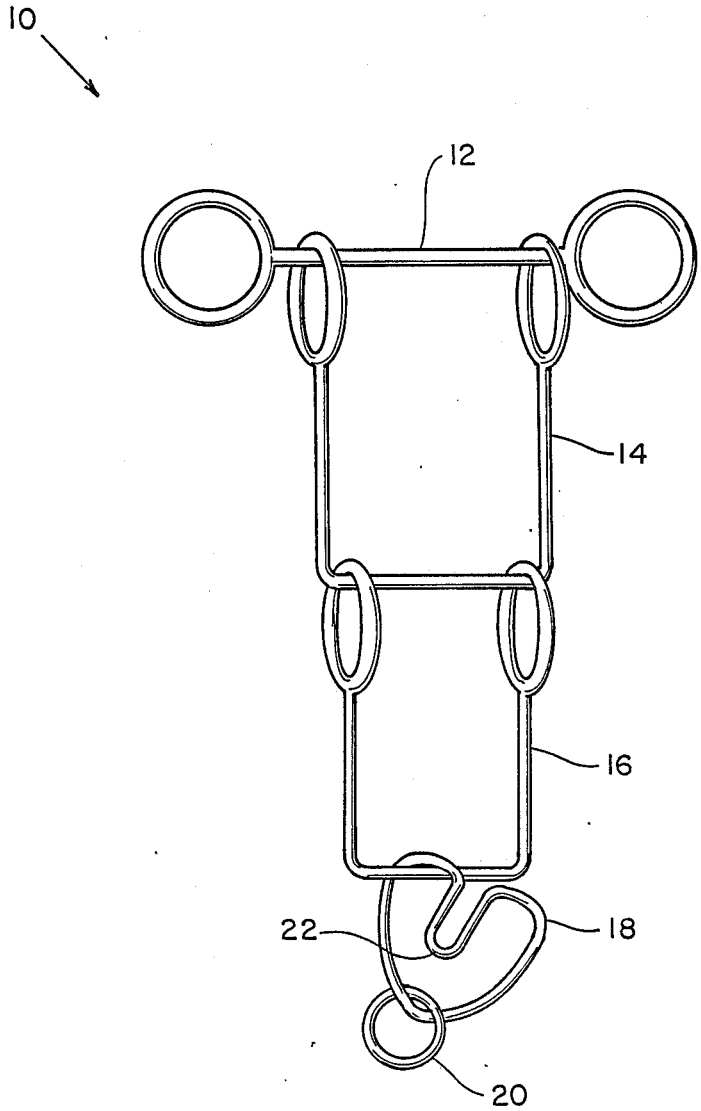
FIG. 1 is a perspective view of the improved captured heart wire-form puzzle comprising the present invention.
Figure 2:
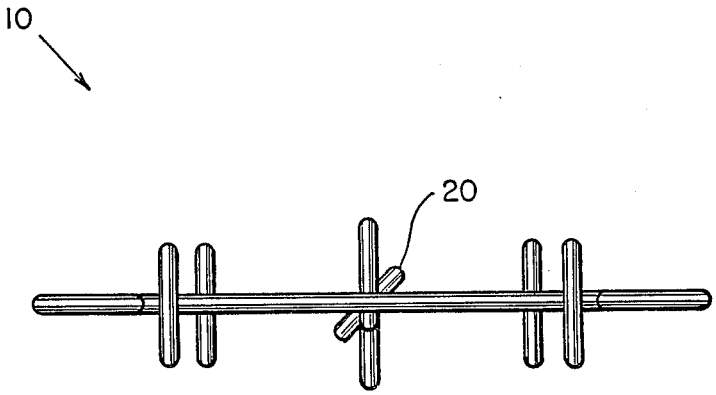
FIG. 2 is a top plan view of the invention.

With reference now to the drawings, and in particular to FIGS. 1 and 2 thereof, a new and improved captured heart wire-form puzzle embodying the principles and concepts of the present invention and generally designated by the reference numeral 10 will be described.

More specifically, it will be noted that the basic configuration of the invention 10 is similar in design and construction to the wire puzzle shown in U.S. Pat. No. 4,524,972, which issued to Charles Wilmarth on June 25, 1985 as priorly discussed and the disclosure thereof is incorporated herein by reference. In this respect, the present invention 10 includes a first dumbbell-shaped capture means 12, a second U-shaped capture means 14 movingly interlocked with the capture means 12, and a third U-shaped capture means 16 movingly interlocked with the second capture means. Further, a heart shaped capture member 18 is illustrated as being movingly attached to the third capture means 16, and all of these components are interlocked substantially as shown in the Wilmarth patent. As to the manner of using the invention as thus far described, the manner is substantially similar to and described in the Wilmarth patent. Accordignly, no further description of the manner of manipulating the puzzle to a final solution appears to be necessitated.

Additionally illustrated in the drawings is a second captured means which consists of a closed loop member or ring 20 which is positioned through the captured heart member 18. The ring 20 may be moved to any desired position about the periphery of the captured heart 18. In solving the puzzle, as the captured heart member 18 is moved through the various loops associated with the capture means 12, 14, 16, the ring 20 will prevent movement of the captured heart member therethrough if it is not properly positioned on the heart member. In this respect, if the ring member is positioned at the base of the cleavage 22 forming a part of the captured heart 18, it will increase the distance "E" illustrated in FIG. 7 of the Wilmarth patent, whereby the captured heart member cannot be moved through a loop associated with the capture means 12, 14, 16. Only when the ring 20 is removed from the cleavage 22 of the captured heart 18 will a solution be possible.

As such, the ring member 20 operates as a means for increasing the complexity of a conventional prior art wire-form puzzle without the necessity of designing new puzzles and their attendant solutions. The ring member 20 is representative of a plurality of differently shaped, loosely fitted members which could be employed to increase the complexity of a conventional puzzle without substantially altering the design or solution thereto, and of course, more than a single ring member could be employed to increase the challenge to a user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wire-form puzzle comprising:

first capture means including a generally planar dumbbell-shaped wire-form element having first circular wire-form elements on opposed ends thereof;

second capture means including a first U-shaped planar wire-form element having second circular wire-form elements on free ends thereof, said second circular wire-form elements being interlocked with first capture means;

third capture means including a second U-shaped planar wire-form element having third circular wire-form elements on free ends thereof, said third circular wire-form elements being interlocked with said second capture means;

captured means including a planar heart-shaped wire-form element having a pointed tip formed in one side and a pair of adjacent arcuate outwardly extending lobes surrounding an inwardly extending cleavage formed in an opposing side, said heart-shaped element being sized for clearance passage through said circular wire-form elements about its tip and cleavage and further being sized for cleavage passage about said circular wire-form elements between its tip and either lobe;

further captured means comprising a closed loop element movingly interlocked with said captured means, wherein said further captured means must be correctly positioned relative to said captured means before said captured means can be released from said first, second and third captured means, and wherein said further captured means is of a ring-shaped design, and wherein said further captured means is of a dimension which allows it to be inserted through said first, second and third circular wire-form elements and defines an enclosed area less than that defined by the heart-shaped wire-form element.

* * * * *